United States Patent [19]

Mellor

[11] 4,200,994

[45] May 6, 1980

[54] DRYING APPARATUS

[75] Inventor: Leslie Mellor, Blackburn, England

[73] Assignee: Edgar Pickering (Blackburn) Ltd., Lancashire, England

[21] Appl. No.: 925,876

[22] Filed: Jul. 18, 1978

[30] Foreign Application Priority Data

Jun. 28, 1978 [GB] United Kingdom ..... 33010/78

[51] Int. Cl.[2] ..... F26B 13/02

[52] U.S. Cl. ..... 34/158; 34/242

[58] Field of Search ..... 15/307; 34/158, 160, 34/162, 163, 242

[56] References Cited

U.S. PATENT DOCUMENTS

| | | | |
|---|---|---|---|
| 1,576,679 | 3/1926 | Smith | 15/307 |
| 1,759,804 | 5/1930 | Pieron | 15/307 |
| 2,164,174 | 6/1939 | Gerard et al. | 34/160 |
| 3,362,087 | 1/1968 | Brock | 34/158 |
| 3,750,428 | 8/1973 | Bruckner | 15/307 |
| 4,118,956 | 10/1978 | Stoyel | 15/307 |

*Primary Examiner*—Larry I. Schwartz

*Attorney, Agent, or Firm*—Watson, Cole, Grindle & Watson

[57] ABSTRACT

Apparatus for drying tufted carpets having stenter chains for advancing the carpet of which one only is laterally adjustable, means for blowing hot air onto opposite sides of the carpet through longitudinal slots in tubes extending transversely to the carpet and tapes coupled to the adjustable chain which blank off the portions of the slots which are offset from the carpet.

4 Claims, 7 Drawing Figures

DRYING APPARATUS

After a tufted carpet has left the tufting machine it is necessary to apply latex to the back of the carpet to lock the stitches to the fabric and a backing of hessian is often applied to the latex. The latex must then be dried and this is effected by passage of the carpet through a drying apparatus in which it is exposed to the action of hot air and during its passage through which the carpet is held by stenter chains, carrying pins engaging the edges of the carpet. This is necessary to prevent shrinkage of the carpet.

The stenter chains must be adjustable laterally to suit the width of the carpet and in existing driers provision has been made for lateral adjustment of both stenter chains.

The invention provides an apparatus, for use in drying tufted carpets following application of latex thereto, comprising a housing, a pair of stenter chains in the housing for engaging the edges of the carpet during its passage through the housing, one stenter chain occupying a fixed position in the housing and the other stenter chain being laterally adjustable to suit the width of the carpet, tubes in the housing which are disposed above and below the stenter chains and extend transversely to the direction of travel of the carpet, the tubes having longitudinal slots constituting nozzles which direct hot air onto the top and bottom surfaces of the carpet, means for blowing hot air into the tubes, and tapes coupled to the adjustable stenter chain and movable with it to blank off the portions of the slots which are offset from the carpet.

The apparatus according to the invention has the advantage in simplicity and economy that lateral adjusting mechanism is required for one of the stenter chains only and that, concomitantly with such adjustment, the nozzle slots are blanked off by the tapes in such manner that only the portions above or below the particular carpet being dried are open to emit hot air. All of the hot air is thus directed onto the carpet and none escapes uselessly from the unwanted portions of the slots.

One embodiment of drying apparatus according to the invention will now be described in detail, by way of example, with reference to the accompanying diagrammatic drawings, in which.

Figure 2:
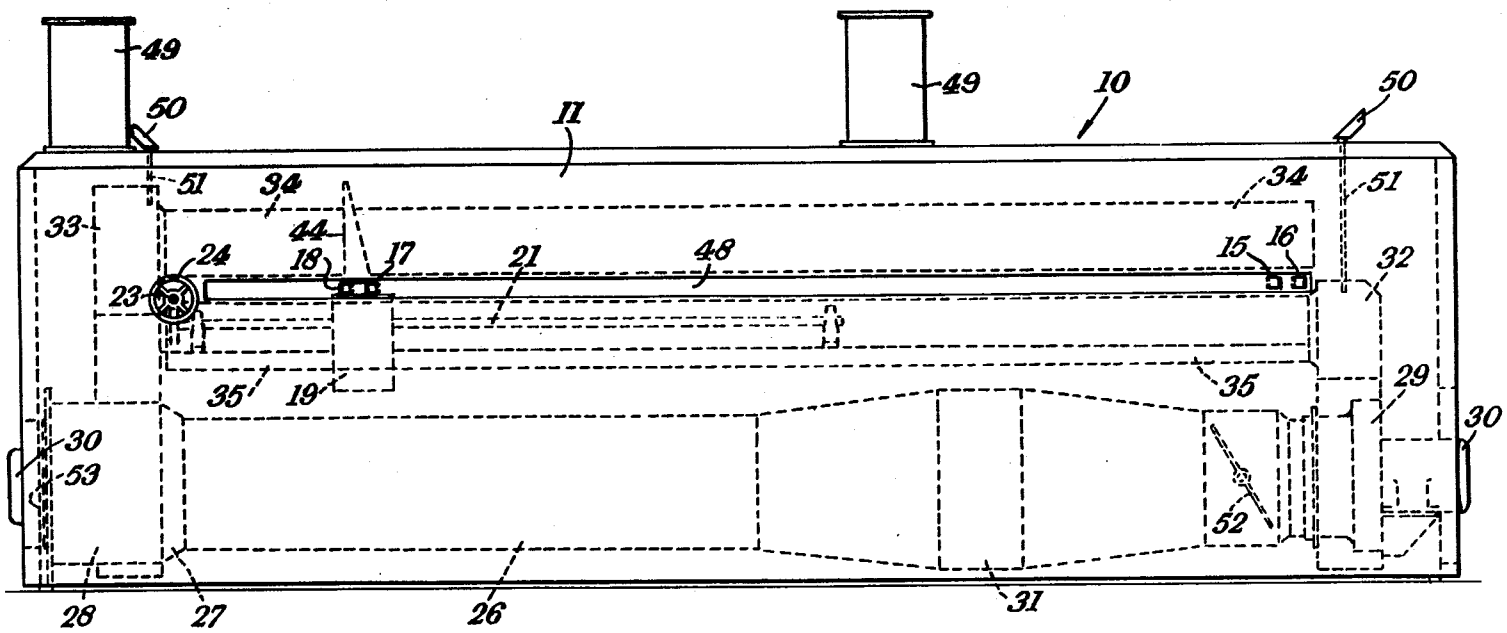
FIG. 2 is an elevation of the right hand end of FIG. 1.

The apparatus includes a housing 10, divided into three contiguous sections 11, through which a carpet 12 (FIG. 3) to be dried is advanced by stenter chains 13, 14. The chain 13 has parallel inner and outer runs accommodated in respective fixed rails 15, 16. The other chain 14 has parallel inner and outer runs accommodated in respective adjustable rails 17, 18, which are carried by a block 19 which incorporates. a nut 20 on a lead screw 21. The lead screw 21 is connected by worm gearing 22 to a shaft 23 carrying a handle 24 (FIG. 2). By rotation of the handle 24, the lead screw 21 can be turned to shift the bracket 19 laterally and so adjust the spacing of the chains 13, 14 to suit the width of the carpet 12 to be dried.

Each section 11 of the housing 10 contains two transversely extending ducts 25, 26. Each duct, as shown most clearly in FIG. 3, has a flared inlet 27 communicating with a cylindrical filter 28, contains at its other end a fan 29, driven by an electric motor 30, and has a heater within an enlarged intermediate section 31 of the duct. The heater may be gas fired or be constituted by a steam or hot oil radiator. The duct 25 draws air in at one side of the housing through its filter 28 and its fan 29 discharges hot air into a fan box 32. The other duct 26 draws air in at the other side of the housing and discharges hot air into a fan box 33 at the opposite side of the housing to the fan box 32. The flared inlets 27 reduce to a minimum the restriction to air flow in the ducts.

Figure 1:
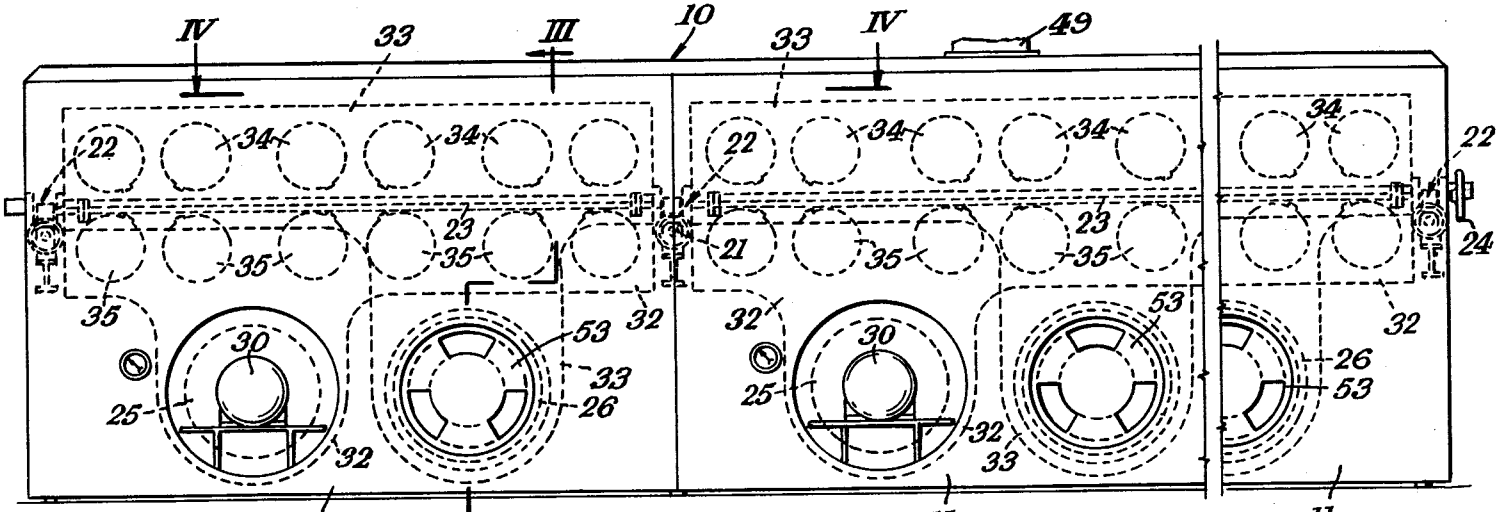
FIG. 1 is a side elevation.
Figure 4:
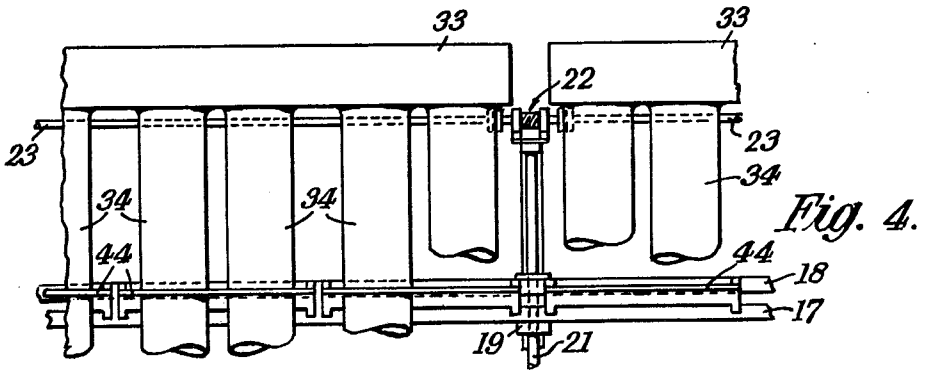
FIG. 4 is a section on the line IV—IV in FIG. 1.

Each fan box 33 discharges hot air into six tubes 34, which are closed at their remote ends and are situated above the carpet. Each fan box 32 discharges hot air into six similar tubes 35 which are disposed below the carpet. The tubes 34, 35 are disposed in pairs as shown in FIG. 1 and have longitudinally extending slots containing nozzles through which converging streams of hot air are directed on the upper and lower surfaces of the carpet.

Figure 7:
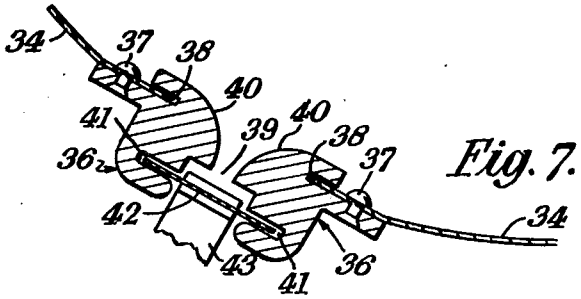
FIG. 7 is an enlarged sectional view showing a detail.
Figure 6:
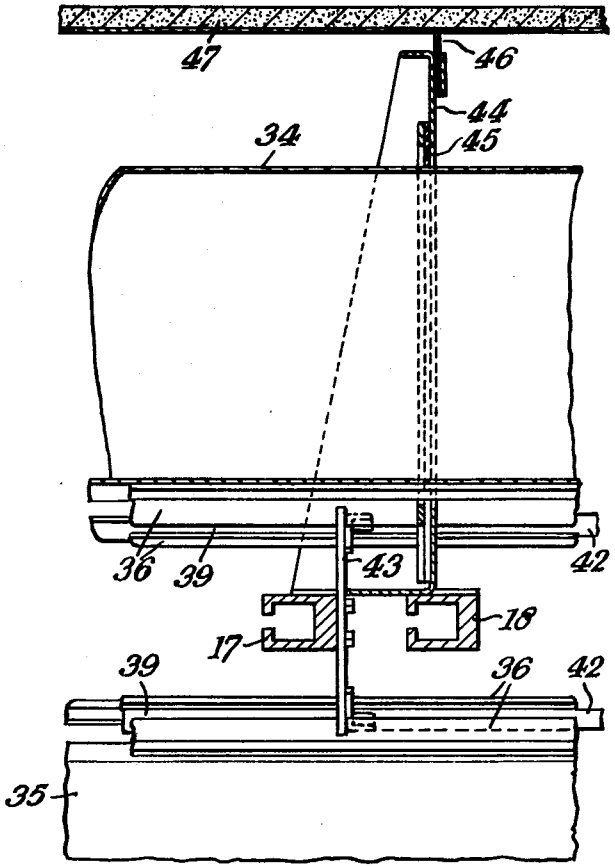
FIG. 6 is a section on the line VI—VI in FIG. 5.

As shown most clearly in FIG. 7, each nozzle is constituted by an extrusion 36, attached by rivets 37 to the tube and having outwardly facing slots 38 into which the edges of the tube are fitted, and defining a continuous longitudinal slot 39 for outflow of air from the tube. The surfaces 40 of the extrusion defining the entry to the slot 39 are rounded to reduce the resistance to airflow. The extrusion has inwardly facing slots 41 to accommodate a flexible steel tape 42 attached at one end to a plate 43 attached, as shown in FIG. 6, to the rail 17 supporting the movable stenter chain 14. The other end of the tape is coiled in a holder (not shown) and spring-loaded in the direction to retract it from the extrusion 36.

The tapes 42 mask those portions only of the slots 39 in the nozzles which are situated at the side of the movable stenter chain 14 remote from the carpet 12. When the chain 14 is moved inwardly to suit a narrower carpet the tapes 42 are drawn forward to reduce the effective length of the slots 39 accordingly. When the chain 14 is moved outwardly to suit a wider carpet, the tapes 42 are retracted to leave the slots 39 unmasked for the full width of the wider carpet.

Figure 3:
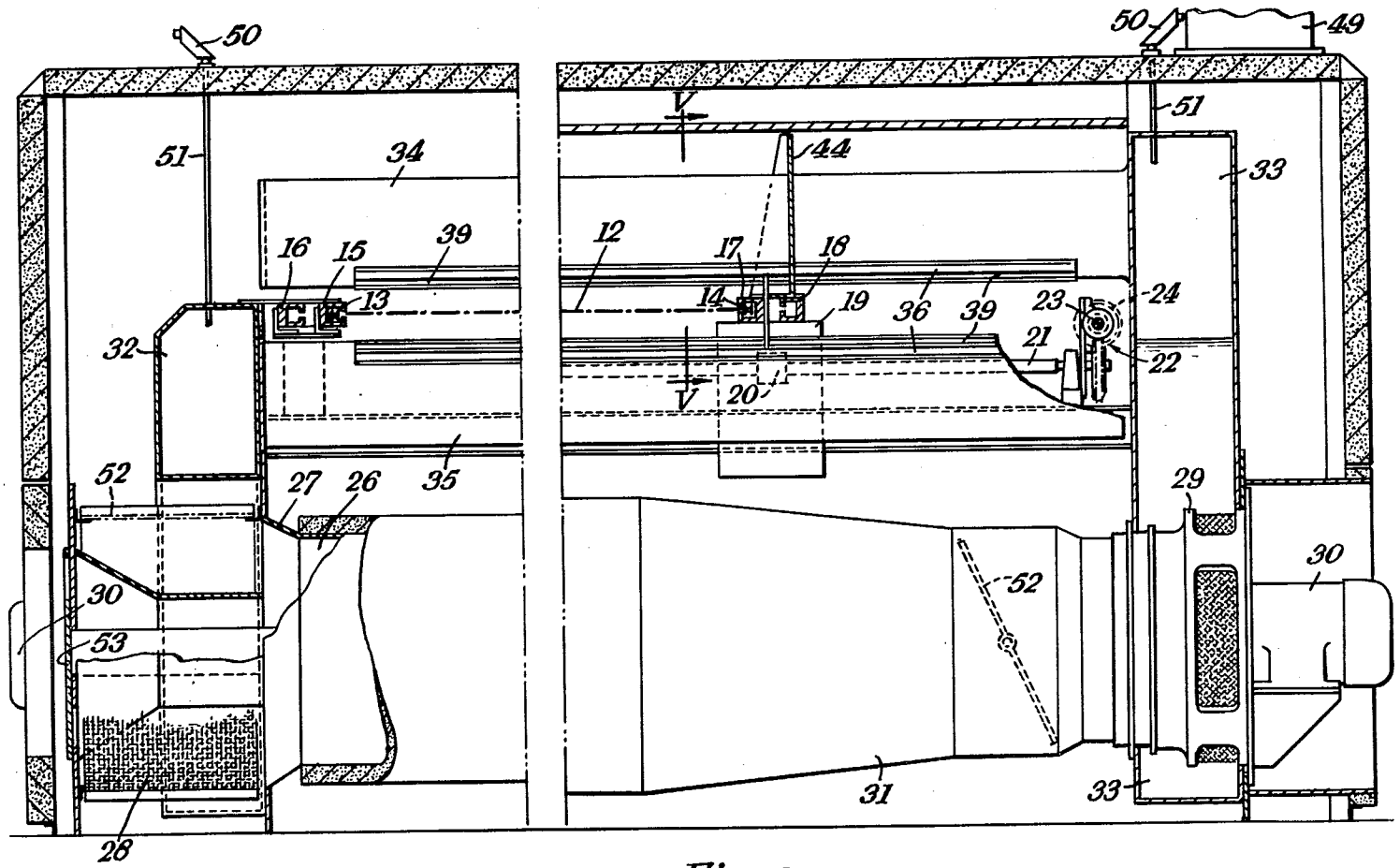
FIG. 3 is a section on a larger scale on the line III—III in FIG. 1.
Figure 5:
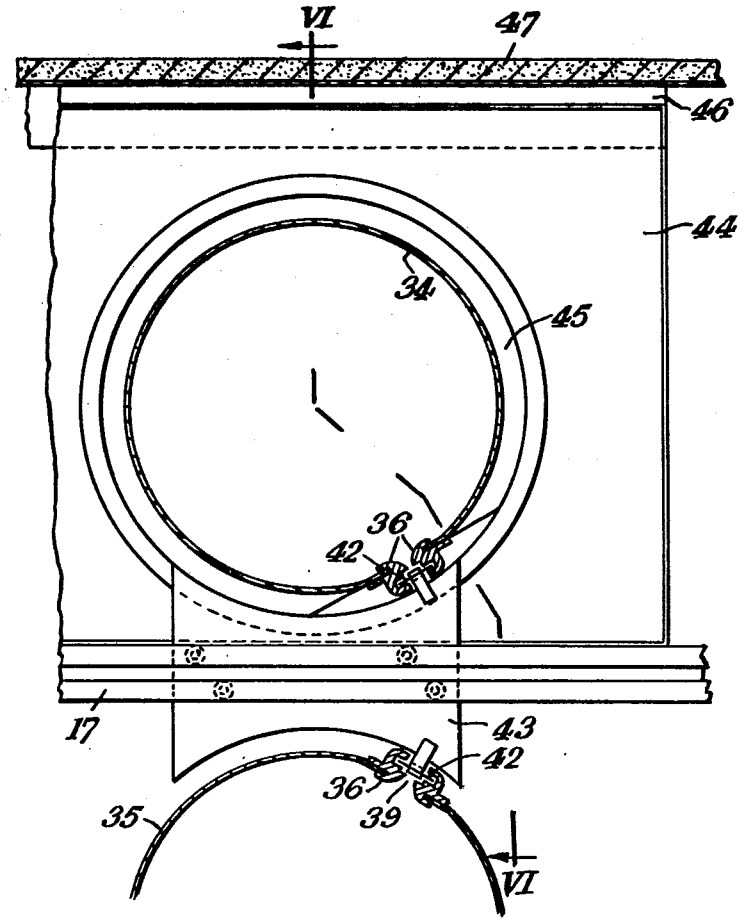
FIG. 5 is a section on the line V—V in FIG. 3.

As shown in FIGS. 5 and 6, the outer movable rail 18 carries an upwardly extending screen 44, formed with apertures containing flexible seals 45 which embrace the upper tubes 34. The upper end of the screen 44 carries a flexible seal 46 which engages a horizontal wall 47, disposed beneath the top wall of the housing as shown in FIG. 3. The screen 44 is accordingly moved laterally in the housing, upon adjustment of the chain 14 to suit a carpet 12 of different width, to increase or decrease the space available in the housing above the carpet for accommodation of hot air.

The housing 10 has slots in its end walls for entry and egress of the carpet 12, the egress slot being shown at 48 in FIG. 2, and exhaust outlets 49, for withdrawal of moisture-laden air. Thermometers 50 having probes 51 are provided for measuring the temperature of the air in the fan boxes 32, 33. Each of the ducts 25, 26 contains a flap valve 52 for regulating the airflow through the duct. Opposite the inlet end of each duct is an adjustable air inlet 53 which can be opened, when desired, to allow external air to be drawn into the duct.

What I claim as my invention and desire to secure by Letters Patent is:

1. A drying apparatus, for use in drying tufted carpets following application of latex thereto, comprising a housing for engaging the edges of the carpet during its passage through the housing, one stenter chain occupying a fixed position in the housing and the other stenter chain being laterally adjustable to suit the width of the carpet, said housing including a space above the carpet for circulation of hot air, tubes in the housing which are disposed above and below the stenter chains and extend transversely to the direction of travel of the carpet, the tubes having longitudinal slots constituting nozzles which direct hot air onto the top and bottom surfaces of the carpet, means for blowing hot air into the tubes, tapes coupled to the adjustable stenter chain and movable with it to blank off the portions of the slots which are offset from the carpet and a screen mounted for lateral movement with said adjustable stenter chain to increase and decrease said space in accordance with the adjustment imparted to said chain.

2. Apparatus as claimed in claim 1, in which each tube includes, fitted into its longitudinal slot, a nozzle constituted by an extrusion defining a continuous longitudinal slot for outflow of air from the tube which has a rounded entry for the air, the extrusion having outwardly facing slots to accommodate the tube and inwardly facing slots to accommodate the tape.

3. Apparatus as claimed in claim 1, which comprises a rail accommodating the movable stenter chain and connected to the tapes.

4. Apparatus as claimed in claim 1, in which the screen has apertures containing flexible seals which embrace the tubes situated above the carpet.

* * * * *

UNITED STATES PATENT OFFICE
CERTIFICATE OF CORRECTION

PATENT NO. : 4200994

DATED : August 6, 1980

INVENTOR(S) : Leslie Mellor

It is certified that error appears in the above-identified patent and that said Letters Patent are hereby corrected as shown below:

On the title page, correct the foreign application priority data to read --August 5, 1977 [GB] United Kingdom . . . 33010/77--.

Signed and Sealed this

*Second* Day of *September 1980*

[SEAL]

*Attest:*

SIDNEY A. DIAMOND

*Attesting Officer*

*Commissioner of Patents and Trademarks*